US005205193A

United States Patent [19]

Wield

[11] Patent Number: 5,205,193

[45] Date of Patent: Apr. 27, 1993

[54] DART TOOL

[76] Inventor: Dennis R. Wield, W1707 County Trunk J, Sheboygan, Wis. 53083

[21] Appl. No.: 721,417

[22] Filed: Jun. 26, 1991

[51] Int. Cl.[5] ..... B25B 13/48

[52] U.S. Cl. ..... 81/176.15; 81/176.1

[58] Field of Search ..... 81/176.1, 176.15, 176.2

[56] References Cited

U.S. PATENT DOCUMENTS 464,084 12/1891 Robinson ..... 81/176.1
582,238 5/1897 Schrader ..... 81/176.1
873,009 12/1907 Baxter ..... 81/176.15
1,344,800 6/1920 Johnson ..... 81/176.1

*Primary Examiner*—Frank T. Yost
*Assistant Examiner*—Hwei-Siu Payer
*Attorney, Agent, or Firm*—Donald Cayen

[57] ABSTRACT

A dart tool simplifies the task of replacing a dart shaft on a dart body. The dart tool is comprised of an elongated handle that defines a recess. A pin secured to the handle extends into the recess. The pin and recess are dimensioned to enable the pin to enter the holes normally present in dart shafts. Applying torque to the dart tool and the dart enables rapid removal and tight replacement of the shaft on the dart body.

7 Claims, 2 Drawing Sheets

DART TOOL

BACKGROUND OF THE INVENTION

1. Field of the Invention

This invention pertains to hand tools, and more particularly to tools for maintaining sports equipment.

2. Description of the Prior Art

The popularity of dart games is increasing rapidly, and the number of both casual players and league players continues to grow. One reason for the widespread participation in dart games is that they can be played almost anywhere a target can be set up, whether indoors or outdoors.

As is known to dart players, a high quality dart is normally composed of four separate components: a brass body, a plastic tip, an aluminum shaft, and a plastic flight. The body typically is a cylinder having a knurled outer diameter and internal threads at both ends. The tip is threaded into one end of the body. The shaft has one end that is threaded into the second end of the body. The second end of the shaft normally has four longitudinally extending slits that frictionally receive corresponding wings of the flight. When properly manufactured and assembled, a dart provides good balance, accuracy, and long service life.

However, with extended use the dart shafts sometimes become bent or otherwise damaged. Using a dart with an imperfect shaft causes wobble and inaccuracy during flight. Consequently, players promptly replace defective shafts with new ones. Shaft replacement is facilitated on many designs by the provision of a small hole drilled through the shaft near its threaded connection with the dart body. A correctly sized pin or the like can be inserted through the shaft hole. Then by firmly holding the body with one hand, the player can apply torque to the pin and thereby unscrew the shaft from the body. Subsequently, a new shaft is screwed into the body.

Unfortunately, a proper pin or the like for inserting into the shaft hole for replacing a faulty shaft is seldom available when needed. Accordingly, a common practice is to use the plastic tip of another dart as the pin. That practice is very risky because of the probability of damage to the tip.

In addition, the threaded joint that renders a dart shaft easily replaceable on a body causes problems in maintaining the shaft tightly in place on the body during normal play. That is because the threaded joint between the body and the shaft has an annoying tendency to loosen during play. As a result, players utilize numerous techniques to keep the shafts tight to their bodies. Some players insert a lock washer between the shaft and the body. Others use tape, caulk, and even potato starch on the threads. Such practices are messy, time consuming, and generally unsatisfactory.

In recognition of the universal problem of maintaining a dart shaft tightly on a body during play while enabling easy removable of the shaft from the body when required, a special tool has been developed and is marketed under the trademark THE DART SHARK. The tool comprises a thin flat plate having a short tip on one end. The tip is designed to enter the holes in dart shafts to aid in removing and replacing the shafts on the dart bodies. The tool has a couple of disadvantages. First, the flat sides and edges of the tip result in sharp corners that tend to deform and upset the soft aluminum material around a shaft hole. In addition, the tip protrudes from the end of the tool so as to create a point like protrusion that tends to quickly wear a hole in a player's pocket or purse.

Thus, a need exists for an improved dart maintenance tool.

SUMMARY OF THE INVENTION

In accordance with the present invention, an inexpensive dart tool is provided that enables a person to easily and quickly remove and replace a dart shaft on a dart body. This is accomplished by apparatus that includes a round pin secured to a handle and extending into a protective recess formed in the handle.

The handle of the dart tool is sized to fit easily into a pocket or purse or on a key ring. For example, the handle may be approximately 3 inches long, 0.38 inches wide, and 0.04 inches thick. The recess is formed near one end of the handle and along one of the handle edges, such that the recess edge intersects the handle edge at two opposed corners. A relatively short land is thus created between the handle end and the adjacent recess corner.

The pin is secured to the handle along the handle land. The pin extends into the recess in a direction parallel to the handle edge. The pin is long enough to pass through the hole of a dart shaft. Further, the recess is large enough to receive the dart shaft between the free end of the pin and the portion of the recess adjacent the second recess corner.

In the preferred embodiment, the handle is made from two identical plates. The pin is placed between the lands of the plates. Then the plates are bent around the pin to bring the two plates into facing contact with each other while wrapping the pin between them. The peripheries of the handle plates are brazed or welded together to form neat and smooth edges that conceal the junction between the two plates.

The dart tool presents a very attractive appearance. Moreover, the location of the pin, which is entirely within the handle recess, minimizes the possibility of the pin free end snagging on or wearing out a pocket or the like in which the tool may be carried.

In a modified embodiment of the present invention, the handle has a recess in the first edge thereof, and the pin is placed perpendicular to the handle edges. The pin is secured to the handle in the area between the second handle edge and the central portion of the recess edge. Preferably, the free end of the pin extends into the recess no farther than the plane of the first handle edge. In another embodiment, the recess is formed in one end of the handle. The pin is parallel to the handle edges, and the pin extends into the recess such that the free end thereof is approximately in line with the handle end. In a further embodiment, the recess is in the form of a slot in the interior of the handle. The pin extends into the slot from one end. The length and width of the slot are sufficient to receive a dart shaft adjacent the pin free end.

The handle and pin of the dart tool of the present invention may be manufactured as a single component, such as by punching them from sheet steel. In that case, the pin is worked as necessary so that it has a round cross section along its length that engages a dart shaft. The pin may also be welded to the handle, if desired, such that the dart tool is made from two components. In that situation, a round pin is used.

Other advantages, benefits, and features of the invention will become apparent to those skilled in the art upon reading the detailed description of the invention.

DETAILED DESCRIPTION OF THE INVENTION

Figure 1:
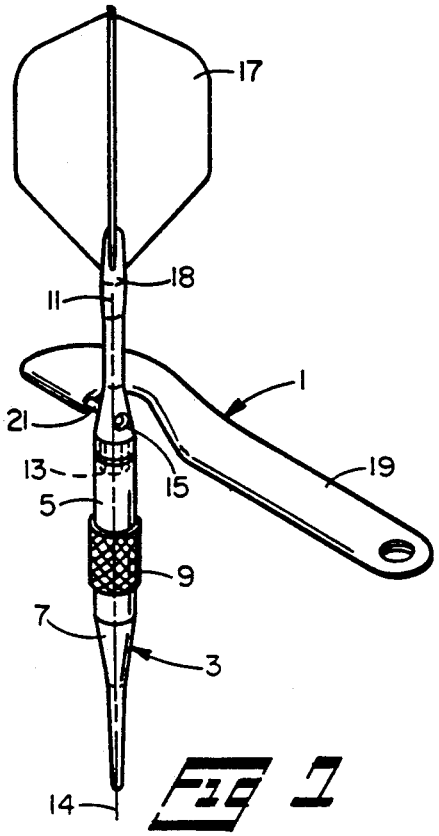
FIG. 1 is a perspective view of the dart tool of the present invention in use with a dart.
Figure 3:
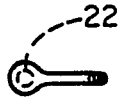
FIG. 3 is a top view of the dart tool.
Figure 4:
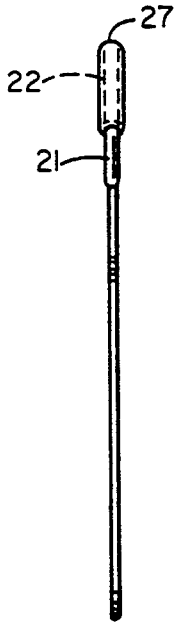
FIG. 4 is an end view of the dart tool.
Figure 2:
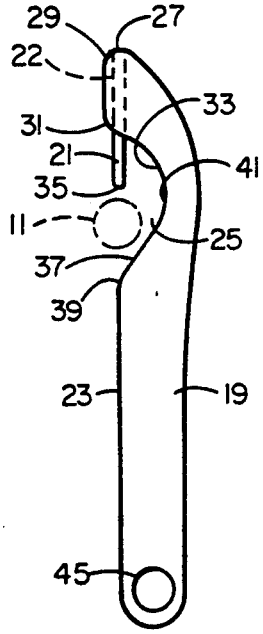
FIG. 2 is a front view of the dart tool of the present invention.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–4, a dart tool 1 is illustrated that includes the present invention. The dart tool is particularly useful for maintaining a conventional dart 3, but it will be understood that the invention is not limited to game related applications.

By way of background, the dart 3 normally consists of a cylindrical body 5, to one end of which is secured a tip 7. The body 5 is usually made of brass, and at least a portion of the outer diameter is knurled as at reference numeral 9. The dart tip 7 may be made of a tough plastic material. To the second end of the body is attached a shaft 11. Attachment of the shaft 11 to the body is by a threaded connection 13; the body is normally tapped to receive threads formed on one end of the shaft. Extending through the shaft and perpendicular to the central axis 14 thereof is a small hole 15. A flight 17 is removably pressed into slits fabricated in the free end 18 of the shaft, as is known in the art.

The dart tool 1 of the present invention is employed to facilitate removal of the dart shaft 11 from the body 5 and for tightly reattaching the shaft onto the body. In the construction illustrated in FIGS. 1–4, the dart tool is comprised of a flat handle 19 and a pin 21 secured to the handle. The handle 19 is relatively long, narrow, and thin. I have found that a handle having a length of approximately 3 inches, a width of approximately 0.38 inches, and a thickness of approximately 0.04 inches works very well. That size is small enough to be easily carried in a pocket or purse or on a key chain buL large enough to be easily manipulated for working on the dart 3.

Along a first longitudinal edge 23 of the handle 19 is formed a recess 25. The recess 25 is relatively near one handle end 27 such that a land 29 is created between the handle end 27 and the corner 31 between the handle edge 23 and the adjacent recess edge 33. The preferred length of the land 29 is between approximately 0.45 inches and 0.50 inches.

The pin 21 has a first end 22 that is secured to the handle 19 in the region of the handle land 29. The pin preferably has a diameter of approximately 0.08 inches, and it extends from the handle land into the recess 25 for a distance of approximately 0.25 inches.

The recess 25 has a size and shape that enables it to receive the dart shaft 11 between the free end 35 of the pin 21 and the recess edge 37 distal from the land 29. Accordingly, there is a space of approximately 0.38 inches between the pin free end 35 and the corner 39 between the handle edge 23 and the recess edge 37 remote from the pin 21. Further, a distance of approximately 0.19 inches is maintained between the pin and the central region 41 of the recess edge. With the dimensions as given, the dart tool pin is insertable into the hole 15 of all popular sized dart shafts.

Figure 5:
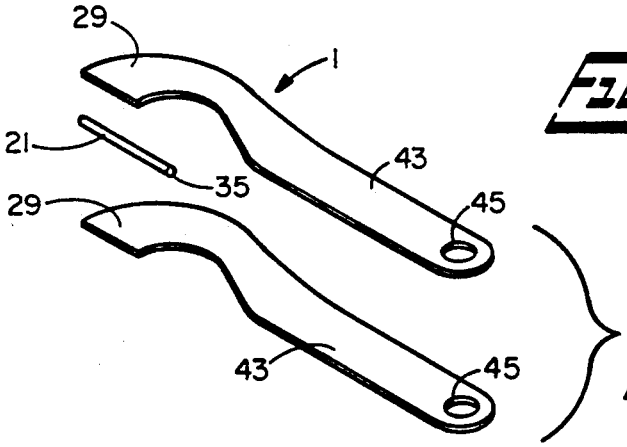
FIG. 5 is an exploded perspective view of the construction of one embodiment of the present invention.

Looking also at FIG. 5, the dart tool 1 may be fabricated from three pieces: two identical handle plates 43 and the pin 21. The two handle plates 43 may be made of stainless steel. The pin is placed between the lands 29 of the two plates. The handle lands are brought into contact with the pin, and the plates are wrapped around the pin so as to enclose it. Simultaneously, the two plates are brought into facing contact with each other along their entire areas except for the portions that are wrapped around the pin 21. Then the entire peripheries of the handle plates, such as the longitudinal edges 23, recess edges 25, and ends 27 are welded or brazed to hide the joint between the two plates and to present the finished appearance of a single piece. If desired, a hole 45 may be punched in the plates for attaching the dart tool 1 to a key ring or the like.

To use the dart tool 1, it is oriented to an attitude such that the plane of the handle 19 is generally perpendicular to the longitudinal axis 14 of the dart 1. The dart is placed within the dart tool recess 25 between the corner 39 and the pin free end 35. The dart is manipulated to bring the hole 15 of the shaft 11 into axial alignment with the dart tool pin 21. Then the pin 21 is inserted into the dart hole 15. The user grips the dart body knurled area 9 with one hand and the tool 1 with the other hand. By applying opposite torques to the dart and tool, the shaft 11 easily unscrews from the body 5. Similarly, a new shaft can be easily screwed back onto the body using the dart tool.

The dart tool 1 enables a player to maintain his darts 3 in a very efficient and inexpensive manner. The tool tightly torques the dart shaft 11 to the dart body 5 such that the shaft remains in place against loosening without the use of adhesives or other undesirable substances. On the other hand, the dart tool enables a player to easily remove even a tightly threaded shaft from the body. Further, the location of the pin 21 within the handle recess 25 protects both the pin against damage and the user's pockets or the like from wearing and snagging when the tool is carried there.

Figure 6:
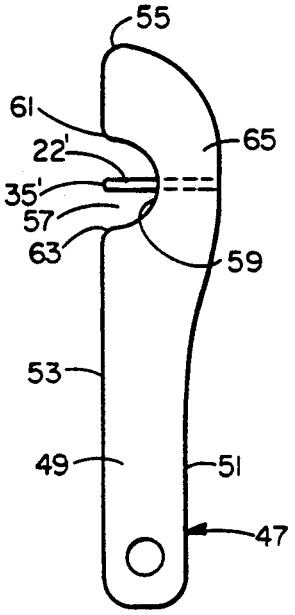
FIG. 6 is a front view of a modified embodiment of the present invention.

Turning to FIG. 6, a modified dart tool 47 is shown. The dart tool 47 has a handle 49 with first and second longitudinal edges 51 and 53, respectively. Near one end 55 of the handle 49 is a recess 57 in the handle edge 53. The depth of the recess 57 at the central portion 59 thereof and the distance between the corners 61 and 63 at the junctions of the recess with the handle edge 53 are sufficient for the recess to completely receive a dart shaft 11. A round pin 22' is secured to the handle in the land 65 between the recess central portion 59 and the handle first longitudinal edge 51. Preferably, the free end 35' of the pin 22' does not extend out of the recess beyond the plane of the handle second edge 53.

Figure 8:
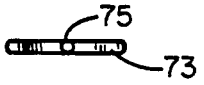
FIG. 8 is a top view of FIG. 7.
Figure 7:
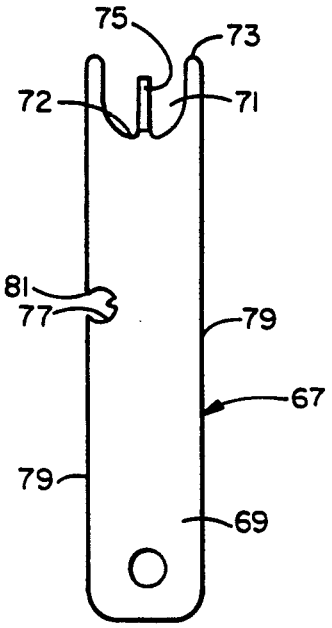
FIG. 7 is a front view of another embodiment of the present invention.

In FIGS. 7 and 8, a dart tool 67 has a handle 69 with a recess 71 formed in one end 73. The recess 71 has the general size and shape of the recess 57 of the dart tool 47 described in conjunction with FIG. 6. That is, the recess 71 has a width and depth at the central portion 72 thereof sized to fully receive a dart shaft 11.

In the dart tool 67, the pin 75 is not a separate component, and the handle 69 is not made of two separate plates. Rather, the pin and handle of the dart tool 67 are fabricated integrally, as by stamping them from a steel sheet approximately 0.08 inches thick. In keeping with an important aspect of the present invention, the pin is processed after stamping so as to have a round cross section. If desired, the tool 67 may include a tip turning accessory in the form of a semi circular cutout 77 in one of the tool side edges 79. Three short but sharp points 81 protrude into the cutout 77.

Figure 9:
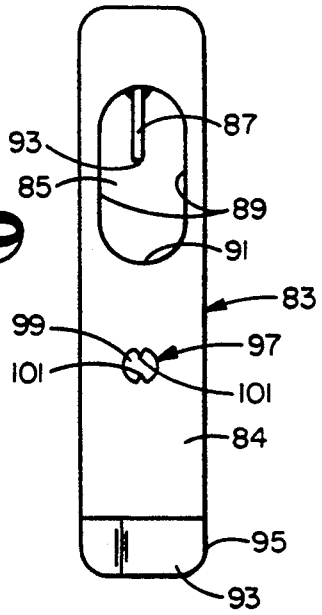
FIG. 9 is a front view of a further modified embodiment of the present invention.
Figure 10:
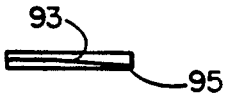
FIG. 10 is a bottom view of FIG. 9.

Next looking at FIGS. 9 and 10, a dart tool 83 has a handle 84 with a recess in the form of an obround slot 85. A round pin 87 protrudes longitudinally into the slot 85. The length and width of the slot are adequate to receive a dart shaft 11 between the slot side edges 89 and between the slot end 91 and the free end 93 of the pin 87.

The dart tool 83 includes a thin ramp 93 on one end of the handle 84. The ramp terminates in a sharp edge 95. The ramp 93 is useful for spreading apart slightly the longitudinal slits in the end 18 of the dart shaft 11 to aid inserting a flight 17 into the slits, as is known in the art.

The dart tool 83 is shown with a tip tightener 97 in the handle 84. The tip tightener 97 is formed as a hole 99 through the handle, with two sharp points 101 protruding into the hole opposite each other. The hole 99 and points 101 are dimensioned to receive and grip the tip 7 of a dart 3 in order to tighten the tip to and untighten it from the dart body 5.

The pin 87 of the dart tool 83 is shown as a separate component welded in the slot 85. It will be appreciated, of course, that the dart tool 83 can be fabricated as a single component, similar to the dart tool 67 of FIGS. 7 and 8, or as three components like the dart tool 1 shown in FIG. 5. Further, the single component dart tool 67 of FIGS. 7 and 8, the two component dart tool 83 of FIGS. 9 and 10, and the three component dart tool 1 of FIG. 5 may be used in any combination with the pin and recess designs of FIGS. 3-5, 6, 7 and 8, and 9 and 10. In each case, the resulting dart tool functions very well for its intended purposes of easily and quickly removing and replacing a dart shaft 11 on a dart body 5, while being convenient to carry for having on hand when needed.

Thus, it is apparent that there has been provided, in accordance with the invention, a dart tool that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A dart tool comprising:

a. an elongated handle having first and second ends and first and second opposed side edges, the first side edge being generally straight between the first and second ends, the handle defining a recess having an edge formed in the first side edge thereof and extending a predetermined distance toward the second side edge thereof, the recess edge intersecting the first side edge at a first corner located at a predetermined distance from the first end to thereby define a straight land extending along the first side edge between the first corner and the first end, the recess edge intersecting the first side edge at a second corner located a predetermined distance from the first corner; and b. a pin having a first end secured to the handle and extending from the recess edge into the recess, the pin having a free end that is located at a predetermined distance from the recess edge to enable a hole in the dart to be placed over the pin, so that the dart tool can be used to apply a torque to the dart.

2. The dart tool of claim 1 wherein the pin is secured to the handle adjacent the first corner thereof, and wherein the pin is generally parallel to the handle first side edge, the pin free end being located at a predetermined distance from the handle second corner to enable a dart to be located in the recess between the pin free end and the handle second corner.

3. Apparatus for maintaining a dart comprising:

a. an elongated handle having first and second ends and first and second side edges, the first side edge being straight and being formed with a recess that intersects the first side edge at first and second corners, the first corner cooperating with the first end to define a straight land of predetermined length along the first edge; and b. a pin having a first end secured to the handle and extending a predetermined distance into the recess.

4. The apparatus of claim 3 wherein:

a. the pin is secured to the handle adjacent the first corner thereof;

b. the pin is generally parallel to the handle land; and c. the pin has a free end located a predetermined distance from the handle second corner to enable a dart shaft to be located between the pin free end and the handle second corner.

5. A dart tool comprising:

a. an elongated flat handle having first and second straight side edges and opposed first and second ends, the first end lying along a generally straight plane perpendicular to said side edges and defining a recess having an edge with a central portion, the recess being sized to receive a dart shaft between the recess central portion and the plane of the first end; and b. a pin secured to the handle and extending into the recess from the central portion thereof, said pin being parallel to said side edges and generally perpendicular to the plane of the handle first end, so that the pin can be inserted into a hole in the dart shaft.

6. The dart tool of claim 5 wherein the pin has a free end that is generally coplanar with the plane of the handle first end.

7. A dart tool comprising:

a. a flat generally planar handle having an interior surrounded by opposed side edges and opposite ends, the handle interior defining an elongated slot therein, the slot having first and second ends spaced a predetermined distance apart and a width greater than the diameter of a selected dart shaft; and b. a pin secured to the handle and extending into the slot from the first end thereof and being generally coplanar with the handle, the pin having a free end located a distance from the slot second end to enable the dart shaft to be inserted into the slot between the pin free end and the slot second end to thereby enable the pin to be inserted into a hole in the dart shaft.

* * * * *